US006106353A

United States Patent [19]

Kimura et al.

[11] Patent Number: 6,106,353

[45] Date of Patent: Aug. 22, 2000

[54] METHOD FOR MANUFACTURING COLOR CATHODE RAY TUBE AND MANUFACTURING APPARATUS THEREFOR

[75] Inventors: Masamichi Kimura; Takashi Kinoshita, both of Takatsuki; Tsutomu Utsumi, Kyoto, all of Japan

[73] Assignee: Matsushita Electronics Corporation, Takatsuki, Japan

[21] Appl. No.: 09/379,877

[22] Filed: Aug. 24, 1999

[30] Foreign Application Priority Data

Aug. 26, 1998 [JP] Japan ..... 10-240148

[51] Int. Cl.[7] ..... H01J 9/14

[52] U.S. Cl. ..... 445/30

[58] Field of Search ..... 445/30, 37

[56] References Cited

U.S. PATENT DOCUMENTS

| | | | |
|---|---|---|---|
| 4,069,567 | 1/1978 | Schwartz | 445/30 |
| 5,681,197 | 10/1997 | Egami et al. | 445/30 |

FOREIGN PATENT DOCUMENTS

| | | | |
|---|---|---|---|
| 61-212495 | 9/1986 | Japan . | |
| 63-298936 | 12/1988 | Japan . | |
| 12980 | 1/1994 | Japan | 445/30 |
| 09007505 | 1/1997 | Japan . | |
| 09007508 | 1/1997 | Japan . | |

OTHER PUBLICATIONS

09007505 A, Patent Abstracts of Japan, Jan. 10, 1997, 1 page.

63298936 A, Patent Abstracts of Japan, Dec. 6, 1988, 1 page.

09007508 A, Patent Abstracts of Japan, Jan. 10, 1997, 1 page.

61212495 A, Patent Abstracts of Japan, Sep. 20, 1986, 1 page.

*Primary Examiner*—Kenneth J. Ramsey

*Attorney, Agent, or Firm*—Rosenthal & Osha L.L.P.

[57] ABSTRACT

A method for manufacturing a color cathode ray tube capable of surely applying a predetermined tension force to a shadow mask and preventing the generation of wrinkles and a manufacturing apparatus of the color cathode ray tube. The method includes applying a compression force to a mask frame formed in a frame shape in the direction in which a gap between at least a pair of facing sides is reduced; and welding and fixing a shadow mask to the upper surface of the mask frame with a tension force applied in the direction opposite to the compression force. In this method, a place to which the compression force is applied is the upper end of the external surface of the mask frame. Thus, a repulsion force in the direction in which a shadow mask is stretched can surely be obtained after the compression force is released, as compared with the case where the same level of compression force is applied to the lower end. Consequently, it is possible to prevent the deterioration of the tension force of the shadow mask.

14 Claims, 6 Drawing Sheets

METHOD FOR MANUFACTURING COLOR CATHODE RAY TUBE AND MANUFACTURING APPARATUS THEREFOR

FIELD OF THE INVENTION

The present invention relates to a color cathode ray tube used for television, a computer display and the like. More specifically, the present invention relates to a method for manufacturing a color cathode ray tube in which a shadow mask is fixed to a frame in a state in which a tension force is applied and to a manufacturing apparatus therefor.

BACKGROUND OF THE INVENTION

Recently, in accordance with the flattening of a front panel of a color cathode ray tube, a shadow mask has also been flattened. As the shadow mask is flattened, a flat surface of the shadow mask cannot be maintained only by supporting a shadow mask main body by a frame as in the prior art. Furthermore, when the shadow mask is merely supported by the frame, the shadow mask is easily subjected to the vibration from the outside, affecting a display screen of the color cathode ray tube. Therefore, the shadow mask is stretched under a constant tension.

On the other hand, in a doming phenomenon in which electron beams collide into the shadow mask to effect a thermal expansion and to deform the surface of the shadow mask, the amount of shift of the electron beams due to the doming is increased especially in the neighborhood of the both ends of a display screen. Therefore, when the shadow mask is stretched and fixed, in order to absorb the thermal expansion due to the collision of the electron beams, the maximum practical level of tension, which is almost the elastic limit, is applied to the shadow mask.

According to such a stretching and fixing, even when the temperature of the shadow mask is increased, the vibration of the shadow mask due to the external vibration and relative shift between electron beam through apertures of the shadow mask and fluorescent dots on a fluorescent screen can be inhibited. A shadow mask that is stretched and fixed is referred to as a tension type shadow mask. Examples of the tension type shadow mask include an aperture grill type shadow mask in which a large number of thin wire materials is stretched and fixed to a mask frame; a slot type shadow mask in which a flat plate is provided with a large number of approximately rectangular electron beam through apertures; and a dot type shadow mask in which a flat plate is provided with a plurality of round shaped electron beam through apertures.

Furthermore, the stretching and fixing method includes a one-dimensional tension method and a two-dimensional tension method. In the one-dimensional tension method, a tension is applied to only the longitudinal direction (vertical direction). On the other hand, in the two-dimensional tension method, a tension force is applied to both the longitudinal direction and width direction. The aperture grill type shadow mask uses the one-dimensional tension method; and the slot type or dot type shadow mask uses the one-dimensional tension method or the two-dimensional tension method.

In order to apply a predetermined tension force to the shadow mask, various kinds of methods have been suggested, in which a tension force is applied to a shadow mask and the shadow mask and a mask frame are welded and fixed with each other in a state in which a compression force is applied to the mask frame (See for example, JP-A No. Sho 63-298936, JP-A No. Hei 8-55577 and JP-A No. Hei 9-7505).

Furthermore, JP-A No. Hei 9-7508 discloses a method in which the compression force is applied to the substrate side of the mask frame.

However, the above-mentioned methods for manufacturing a color cathode ray tube according to the prior art have the following problems.

(1) In a case where the compression force is applied to many places on the mask frame, the distribution of the compression force is not uniform and the difference in the compression force is increased between the portion to which the compression force is applied and the other portion, and thus the frame is deformed. Therefore, when the compression force is released after welding, wave-like deformation of the frame is reflected on the tension force of the shadow mask, causing wrinkles on the shadow mask.

(2) In the method for applying the compression force to the substrate side of the mask frame, the compression force is released after the shadow mask and mask frame are welded and fixed to each other, a sufficient repulsion force is not applied to the upper end of the mask frame, and thus a predetermined tension force cannot be maintained.

SUMMARY OF THE INVENTION

It is therefore an object of the present invention to provide a method for manufacturing a color cathode ray tube capable of surely applying a predetermined tension force to a shadow mask, and further capable of preventing wrinkles from occurring on the shadow mask and to provide a manufacturing apparatus.

In order to achieve the above-mentioned object, the method for manufacturing a color cathode ray tube of the present invention includes the steps of: applying a compression force to a mask frame that is formed in a frame shape in the direction in which a gap between at least a pair of facing sides is reduced; and fixing a shadow mask to the upper surface of the mask frame by welding with a tension force applied in the direction opposite to the compression force, wherein a place to which the compression force is applied is the upper end of the external surface of the mask frame.

According to such a method for manufacturing a color cathode ray tube, the compression force is applied to the upper end of the external surface of the mask frame as compared with the case where the same level of compression force is applied to the lower end and the tension force of the shadow mask is surely maintained by a repulsion force after the compression force is released. Consequently, the deterioration of the tension force of the shadow mask can be prevented.

It is preferable in the above-mentioned method that a cross sectional shape of each side of the mask frame to which a compression force is applied includes an approximately L-shaped part, and the place to which the compression force is applied is the upper end of the external surface of an upright portion of the approximately L-shaped portion.

Furthermore, it is preferable in the above-mentioned method that the compression force is applied by bringing a flexible plate member into direct contact with the entire length of one side of the mask frame. According to such a method for manufacturing a color cathode ray tube, the compression force is dispersed. As a result, uniform distribution or the smoothly changing distribution of the compression force can be realized. Thus, wrinkles on the shadow mask can be inhibited after compression force is released.

Furthermore, it is preferable that the shadow mask is held at a predetermined position by a holding means before a tension force is applied to the shadow mask, thereby positioning the shadow mask. According to such a method for manufacturing the color cathode ray tube, it is possible to apply a tension force and to weld in a state in which the shadow mask is surely held at the predetermined position. Furthermore, it is preferable that the holding means uses a magnet adhering to the shadow mask.

Furthermore, it is preferable that the holding means adheres to the shadow mask by a suction force by vacuum pulling.

Furthermore, it is preferable that the shadow mask is held in a curved shape by the holding means.

Furthermore, it is preferable that the curved shape is held by adhering to the shadow mask to the curved portion formed on the holding means.

Furthermore, it is preferable that the shadow mask is stretched outward with respect to its center by using the holding means in a state in which it is fixed to the holding means before a tension force is applied to the shadow mask, thereby fixing the shadow mask to the holding means while being stretched. According to the above-mentioned method for manufacturing the color cathode ray tube, since the tension force can be applied to the shadow mask without wrinkles generated on the shadow mask, the disadvantage of nonuniformity in stress occurring on the shadow mask after welding, thus causing the generation of wrinkles, can be prevented.

Next, the manufacturing apparatus for a color cathode ray tube includes the steps of applying a compression force to a mask frame that is formed in a frame shape in the direction in which a gap between at least a pair of facing sides is reduced; fixing a shadow mask to the upper surface of the mask frame by welding with a tension force applied in the direction opposite to the compression force, and the apparatus comprising a pressure device for applying the compression force, wherein the place to which the compression force is applied is the upper end of the external surface of the mask frame.

According to the above-mentioned color cathode ray tube, the compression force is applied to the upper end of the external surface of the mask frame. In this case, the tension force of the shadow mask due to the repulsion force after the compression force is released is surely maintained compared with the case where the same level of compression force is applied to the lower end. Consequently, it is possible to prevent the deterioration of the tension force of the shadow mask.

It is preferable in the above-mentioned manufacturing apparatus that the pressure device has a flexible plate member having a length ranging the full length of one side of the mask frame, and applying of the compression by the pressure device is carried out by bringing a flexible plate member into a direct contact with the entire length of one side of the mask frame. According to the above-mentioned apparatus for manufacturing a color cathode ray tube, the uniform distribution or the smoothly changing distribution of the compression force can be realized. Thus, generation of wrinkles on the shadow mask can be inhibited after compression force is released.

Furthermore, it is preferable that the apparatus has a holding means for holding the shadow mask at a predetermined position, and the shadow mask is held at a predetermined position by a holding means before a tension force is applied, thereby positioning the shadow mask. According to the above-mentioned manufacturing apparatus, the tension force can be applied to the shadow mask and welding can be carried out in a state in which the shadow mask is surely held.

Furthermore, it is preferable that the holding means uses is a magnet adhering to the shadow mask.

Furthermore, it is preferable that the holding means adheres to the shadow mask by using a suction force by vacuum pulling.

Furthermore, it is preferable that the shadow mask is held in a curved shape by the holding means.

Furthermore, it is preferable that the curved shape is held by adhering to the shadow mask to the curved portion formed on the holding means.

Furthermore, it is preferable that the shadow mask is stretched outward with respect to its center by the holding means in a state in which it is fixed to the holding means before a tension force is applied to the shadow mask, thereby fixing the shadow mask to the holding means while being stretched. According to the above-mentioned method for manufacturing the color cathode ray tube, since the tension force can be applied to the shadow mask without wrinkles generated on the shadow mask, the disadvantage of nonuniformity in stress occurring on the shadow mask after welding, thus causing the generation of wrinkles, can be prevented.

BRIEF DESCRIPTION OF THE DRAWINGS

FIG. 5(*b*) is a side elevation view showing a mask frame before and after it is deformed according to a comparative example.

DETAILED DESCRIPTION OF THE INVENTION

Hereinafter, the present invention will be described by way of embodiment with reference to the drawings.

Figure 1A:
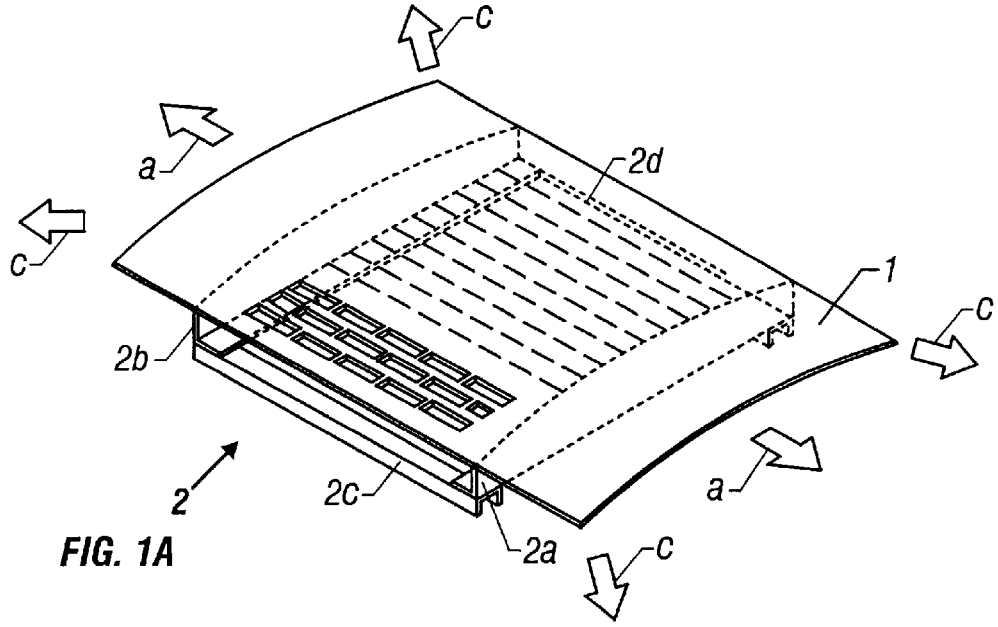
FIG. 1 is a perspective view showing a state from a process in which a shadow mask is set to a process in which the shadow mask is stretched and fixed in one embodiment of the present invention.
Figure 1B:
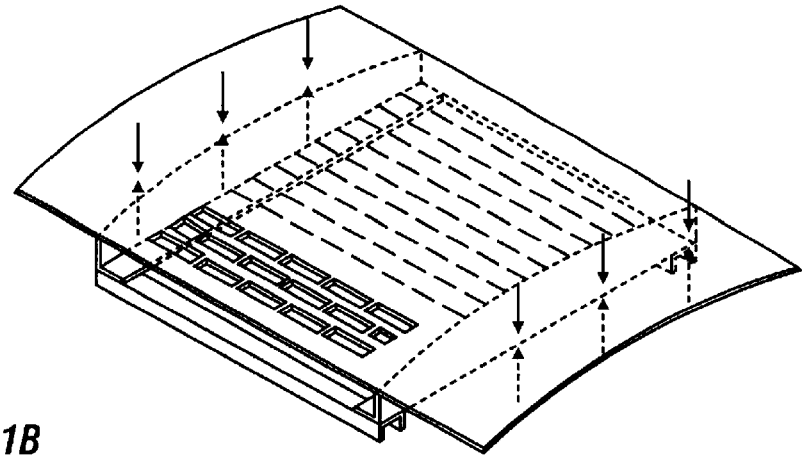
Figure 1C:
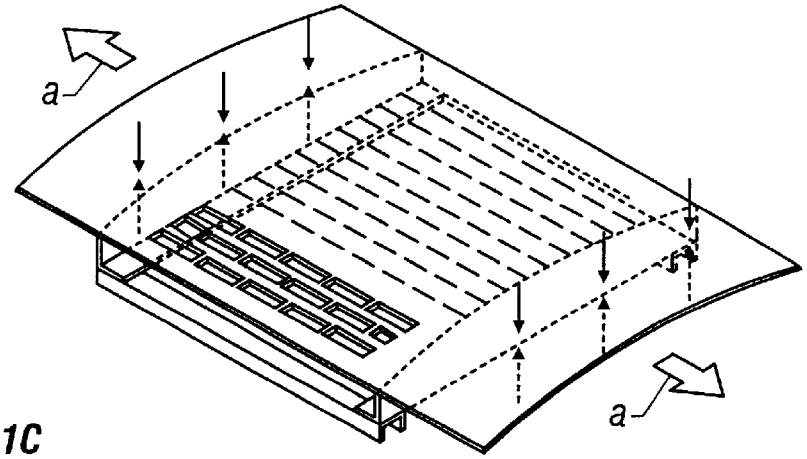
Figure 2A:
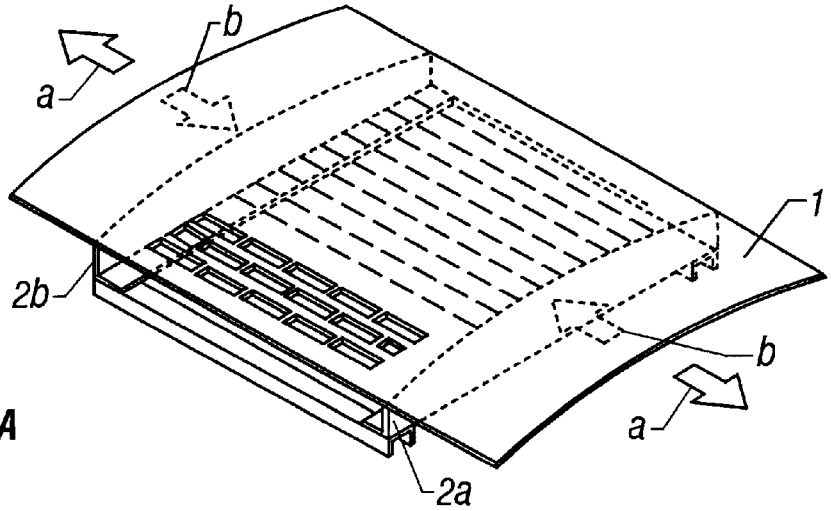
FIG. 2 is a perspective view showing a state from a process in which the mask frame is pressed to a process in which the shadow mask is cut in one embodiment of the present invention.
Figure 2B:
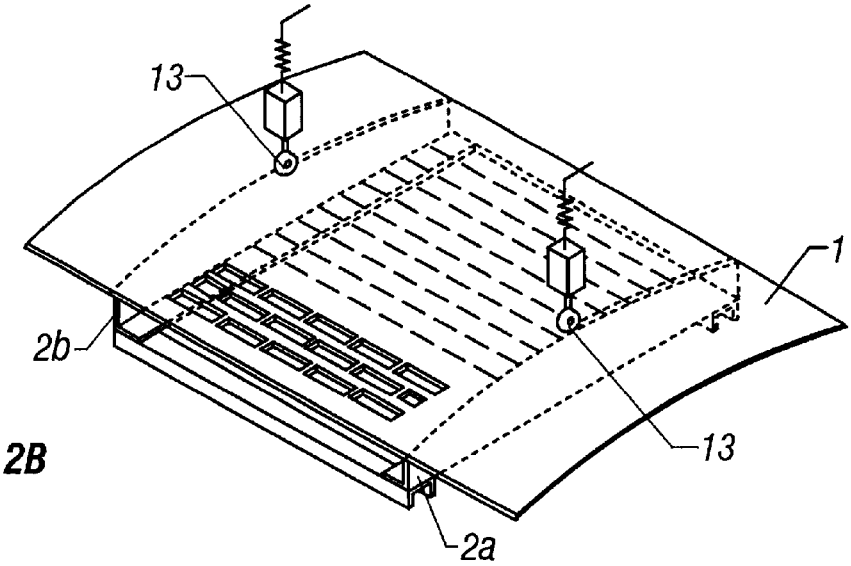
Figure 2C:
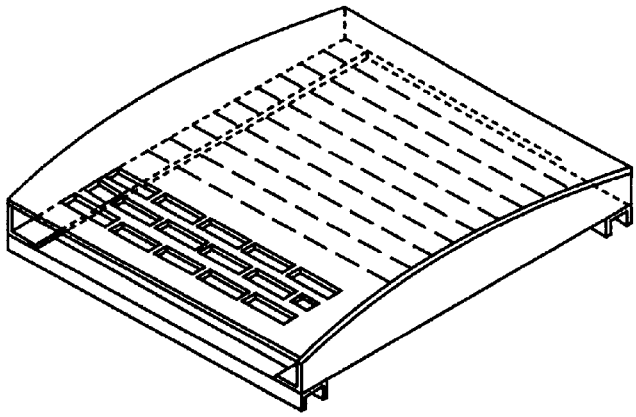

FIG. 1 shows processes from a process in which a shadow mask is set to a process in which a mask frame is stretched and fixed, in this order; and FIG. 2 shows processes from a process in which the mask frame is pressed to a process in which the shadow mask is cut, in this order, respectively.

Figure 3:
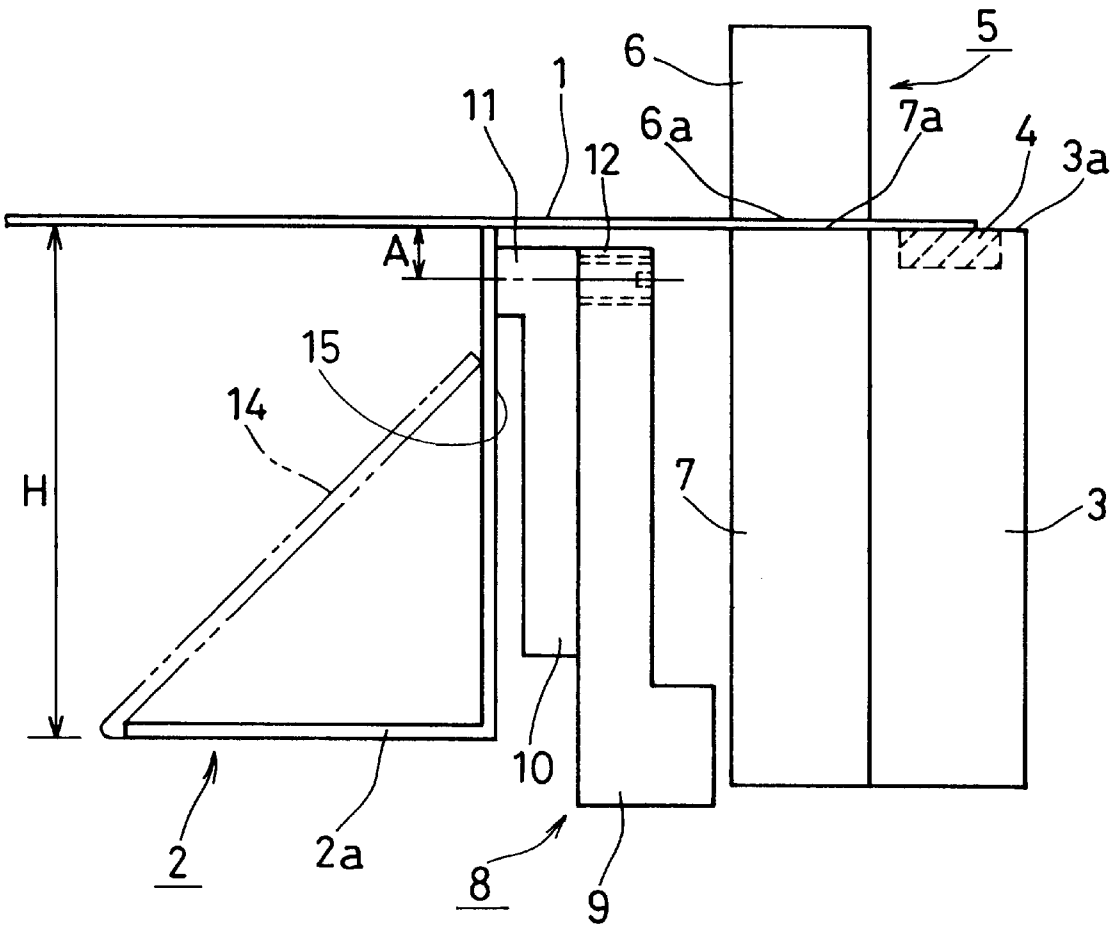
FIG. 3 is a view showing an arrangement of a pressure device, a chucking device and a holding device in one embodiment of the present invention.

FIG. 3 shows an arrangement of the mask frame pressing device ("pressing device" will be referred to hereinafter), the shadow mask chucking device ("chucking device" will be referred to hereinafter), and the shadow mask holding device ("holding device" will be referred to hereinafter). In the process views of FIGS. 1 and 2, each device shown in FIG. 3 is omitted.

Hereinafter, the manufacturing process will be explained in order with reference to FIGS. 1 to 6. FIG. 1(*a*) shows a process in which the shadow mask is set. The shadow mask 1 is an example of the slot type one-dimensional tension type shadow mask. Furthermore, the mask frame 2 is a rectangular frame. Upper and lower long side frames 2*a* and 2*b* are respectively fixed to right and left of short side frames 2*c* and 2*d* so as to form the mask frame 2.

In this process, the holding device 3 shown in FIG. 3 holds the shadow mask 1 and positions the shadow mask 1 with respect to the mask frame 2. This positioning is carried out by putting a projection provided on the holding device 3 into a hole or a notch provided on the shadow mask 1.

The holding device 3 has an upper face 3*a* of a predetermined curved shape, for example circular shape. Moreover, the upper surface 3*a* is provided with an adsorption portion 4 with which the shadow mask 1 is adhered, thus keeping the predetermined curved surface.

The adsorption by the adsorption portion 4 uses, for example, a magnet, a vacuum pulling, or the like. In the case of using the magnet, the magnet inserted in the upper surface 3*a* of the mask holding device 3 may be used. In the case of using vacuum pulling, an air suction opening may be provided on the upper surface 3*a* of the mask holding device 3.

Wrinkles and sagging are removed from the shadow mask by sufficiently stretching the shadow mask 1 in the outward direction with respect to its center while holding the shadow mask 1 in a curved shape. The direction in which the shadow mask is stretched may be only in the stretched direction (the direction shown by the arrow a of FIG. 1(*a*)) or in a direction diagonal to the shadow mask 1 (the direction shown by the arrow c of FIG. 1(*a*)) or in both directions. In this case, the shadow mask 1 is stretched by moving the holding device 3 in the direction in which the shadow mask 1 is stretched or by sliding the magnet pieces located on the four corners of the shadow mask 1 in the radial direction.

According to the methods, the shadow mask 1 can be fixed in a state in which the shadow mask is stretched on the mask frame 2. With such a method, since a tension force can be applied without wrinkles generated on the shadow mask 1 in the next process, nonuniformity in stress occurring on the shadow mask after welding, thus causing the generation of wrinkles, can be prevented.

FIG. 1(*b*) shows the chucking process of the shadow mask. In this process, the chucking device 5 shown in FIG. 3 is used. The shadow mask 1 is sandwiched by an upper chucking jig (fixture) 6 and a lower chucking jig 7.

The upper chucking jig 6 has a lower surface 6*a* that is a curved surface (concave shape). The lower chucking jig 7 has an upper surface 7*a* that is a curved surface (convex shape). Therefore, when the shadow mask 1 is sandwiched between the upper chucking jig 6 and the lower chucking jig 7, a predetermined curved shape that is the same as the upper surface 3*a* of the holding device 3 is kept.

FIG. 1(*c*) shows a process in which the shadow mask is stretched. In this process, the shadow mask 1 sandwiched by the chucking device 5 from the upper and lower sides is stretched and tension force is applied in the direction of the arrow a.

Figure 4:
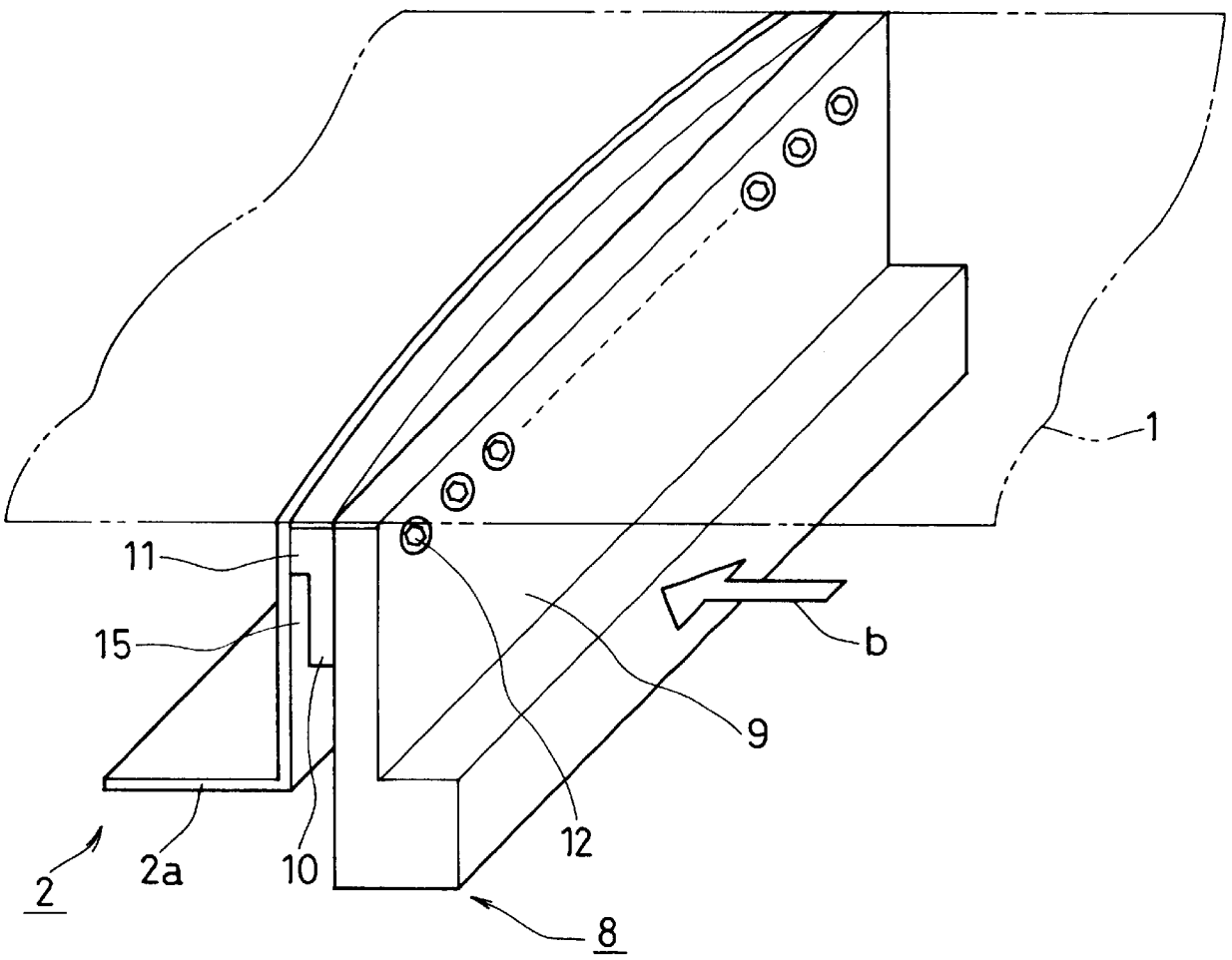
FIG. 4 is a perspective view showing a pressure device in one embodiment of the present invention.

FIG. 2(*a*) shows a process in which the mask frame is pressed. In this process, compression force (shown by arrow b) is applied to the side face of an upright portion of the L-shaped portion. FIG. 4 is a perspective view showing a pressing device used in this process in one embodiment of the present invention. FIG. 4 shows only the side of the frame 2*a*, but the same device is located also in the side of the frame 2*b*.

The pressing device 8 is provided with a pressing block 9 and a pressing plate 10. The pressing plate 10 is fixed to the pressing block 9. For the pressing plate, a flexible material such as polyacetal copolymer (name of the commercial product: Duracon™) can be used. The compression force is applied to the mask frame 2 by applying the force in the direction shown by the arrow b by using the pressure block 9.

Figure 5A:
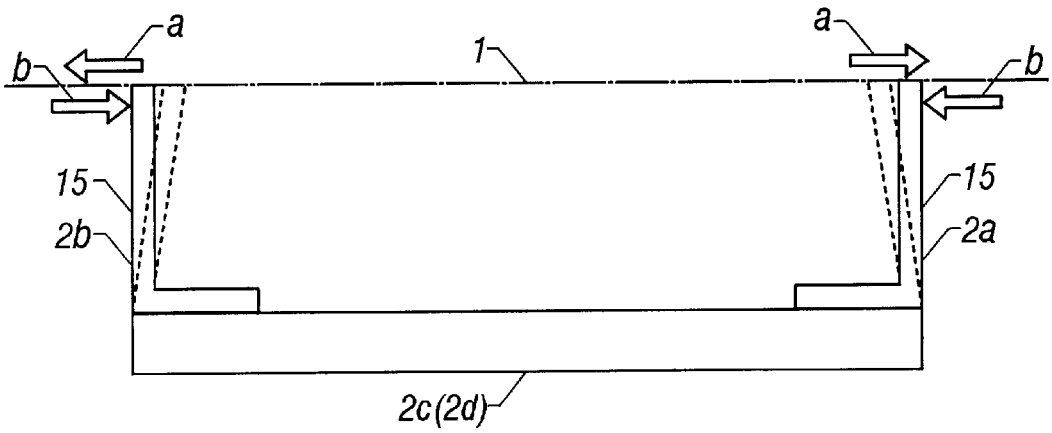
FIG. 5(*a*) is a side elevation view showing a mask frame before and after it is deformed in one embodiment of the present invention.
Figure 5B:
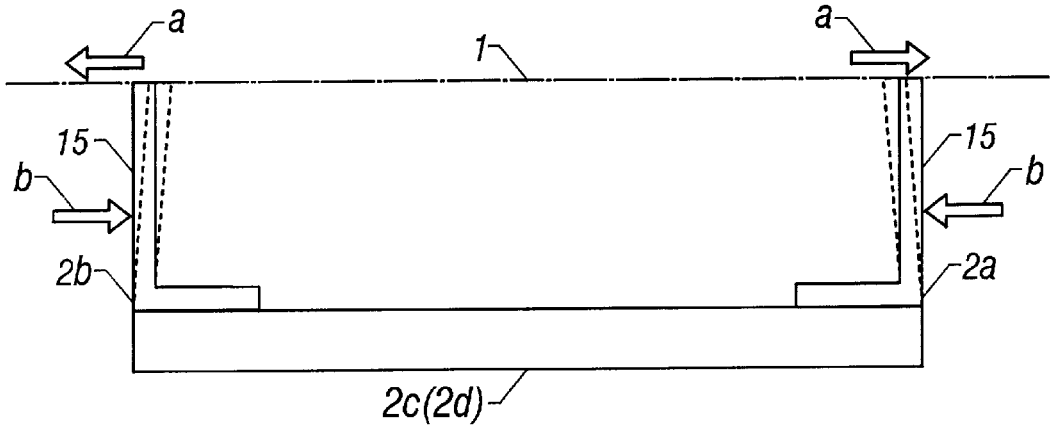

The pressure plate 10 is provided with a projecting portion 11 on the upper end. Therefore, the place to which the compression force is directly applied is the upper part of the side face of the upright portion 15 of the long side frames 2*a* and 2*b* that are in direct contact with the projecting portion 11. FIG. 5(*a*) shows the states before and after the mask frame 2 is deformed when the compression force is applied to the upper end of the side surface of the upright portion 15. The state in which the compression force is applied is shown by the double-dashed lines.

Since the compression force is applied to the upper end of the side face of the upright portion 15 (in the direction shown by the arrow b), the upper end of the side face of the upright portion 15 is surely bent inward. In this case, at the upper end of the side face of the upright portion 15, the compression force is balanced with a repulsion force. The repulsion force means a force in which the upright portion 15 is to return to the original vertical direction by the effect of the spring action. In addition, the tension force is added to the shadow mask 1 (arrow a). As mentioned below, in this case, the upper end of the upright portion 15 and the shadow mask 1 are welded with each other, and then the compression force is released. When the compression force is released, the tension force of the shadow mask 1 balances with the repulsion force of the upright portion 15.

As mentioned above, when the compression force is applied to the upper end of the side face of the upright portion 15, the compression force is balanced with the repulsion force of the upright portion 15. Therefore, if the tension force is applied in a manner in which the compression force is equal to the tension force of the shadow mask 1, after the compression force is released, the repulsion force of the upright portion 15 balances with the tension force of the shadow mask 1. Therefore, the upright portion 15 is not shifted and so is kept in a state where the compression force is applied. In other words, the tension force of the shadow mask 1 is kept as it is, thus preventing the deterioration of the stretching force.

FIG. 5(*b*) show a comparative example in which the compression force is equal to the tension force of the shadow mask 1, and a place to which the compression force is applied is the lower end of the side face of the upright portion 15. In this case, the amount of inward shift of the upper end of the upright portion 15 is reduced as compared with the case where the compression force is applied to the upper end of the side face of the upright portion 15. In other words, the force at the compressed point is equal to the tension force of the shadow mask 1, however, in the upper end of the side face of the upright portion 15, the repulsion force of the upright portion 15 that is equal to the tension force of the shadow mask 1 is not secured.

Therefore, after the compression force is released, the tension force of the shadow mask 1 is larger than the repulsion force of the upright portion 15. Consequently, they are balanced with each other in a state in which the upright portion 15 is further shifted inward. In this state, the tension force of the shadow mask 1 is lowered as compared with that before the compression force is released. In order to prevent the deterioration of the tension force of the shadow mask 1, it is necessary to increase the compression force. In this case, it is difficult to control the appropriate compression force and furthermore the equipment becomes larger.

Furthermore, when the compression force is applied to the lower end, even if the compression force is increased, only the lower part is compressed, the upper end of the upright portion is hardly shifted inward, and sometimes the upper end of the upright portion bends outwards. In this case, even if the compression force is increased, the repulsion force of the upright portion in the direction in which the tension force is applied cannot be obtained.

As mentioned above, by applying the compression force to the upper end of the side face of the upright portion, the repulsion force in the direction in which the tension force is applied to the shadow mask can securely be obtained as compared with the case where the same level of compression force is applied to the lower end. Furthermore, it is easy to equalize the repulsion force to the tension force, thus preventing the deterioration of the tension force of the shadow mask 1.

It is preferable that the place to which the compression force is applied satisfies the relationship: $A \leqq 0.15H$, wherein H denotes the height of the upright portion of the frame shown in FIG. 3; and A denotes a length from the upper face of the upright portion 15 to the center of the projective portion 11. In this embodiment, H is 37 mm, A is 4 mm, tension force of 200 kgf in total is uniformly applied to the shadow mask 1 and a compression force of 200 kgf in total is applied to the mask frame. After welding, when the compression force is released, the necessary tension force was secured in the shadow mask 1.

Furthermore, as mentioned above, the compression force is added to the surface of the upright portion 15 of the long side frames 2*a* and 2*b* via the pressing plate 10. Since the pressure plate 10 is formed of flexible material, it is possible to easily enhance the uniformity of the distribution of the compression force applied to the surface 15 of the upright portion of the mask frame. For example, in a case where the compression force is applied to many places of the mask frame, even if the compression force of each applied place is constant, however, the compression force distribution between applied portions is not uniform. In order to enhance the uniformity of the pressure distribution, a large number of places are applied with pressure. Thus, the complicated device was required.

When the compression force is applied to the mask frame via the pressing plate 10, the compression force is transmitted in a dispersing form. Consequently, the uniformity of the distribution of the compression force is enhanced as compared with the case where the applied place is the same and the pressing plate is not used. Therefore, it is possible to uniformly distribute the compression force of the mask frame with a simple structure.

Furthermore, when the uniform compression force is not required, the distribution of the compression force can smoothly be changed. In a case where the compression force is directly applied to the mask frame, the compression force in the applied portion is projected, however, the compression force is dispersed by applying the compression force via the pressing plate 10 made of flexible material. Thus, the distribution of the compression force is smoothly changed.

Figure 6:
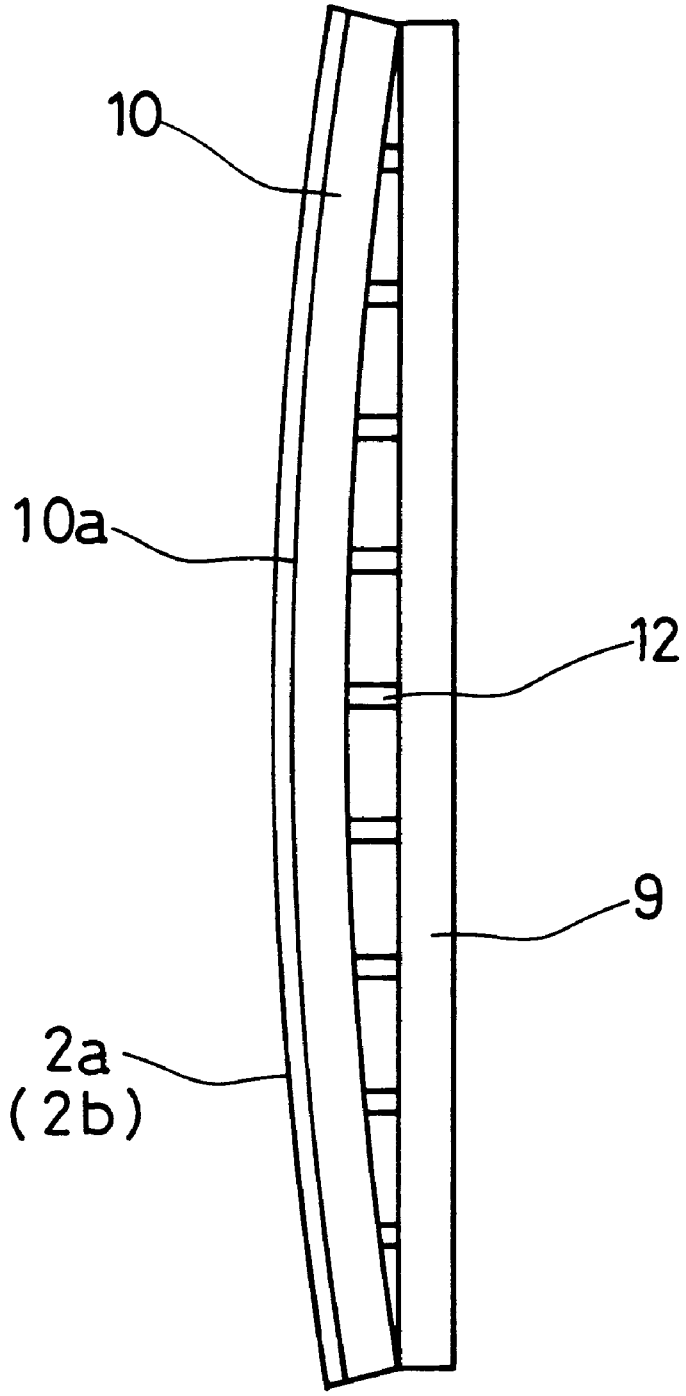
FIG. 6 is a plan view showing an embodiment of pressing by the pressure plate of the pressure device according to the present invention.

FIG. 6 shows an embodiment in which pressing is carried out by using a pressing plate in a case where the compression force distribution is not uniform. FIG. 6 is a plan view showing a state in which pressure is applied. The pressing plate 10 is bent due to pressing adjusting screws 12 to form a curved shape of the pressing face 10*a*. If the pressure is applied by using such a pressing plate 10 like this way, the long side frames 2*a* and 2*b* are also deformed along the curved shape of the pressing face 10*a*, thus enabling the distribution of the compression force on the long side frame to change.

As mentioned above, in a case where the distribution of the compression force is uniform, or the distribution is smoothly changed, the tension force applied to the shadow mask after the compression force is released is uniformly distributed, thus preventing the generation of wrinkles of the shadow mask after the compression force is released.

Moreover, in a case where the tension force applied to the shadow mask is uniform, and as mentioned above, the compression force applied to the mask frame is changed, at the portion where the compression force is small after the compression force is released, the tension force of the shadow mask is reduced, and at the portion where the compression force is large after compression force is released, the tension force of the shadow mask is increased. When the compression force is distributed so that the tension force is small on both sides of the shadow mask, when the shadow mask is subjected to vibration, it can be rapidly attenuated.

FIG. 2(*b*) shows the welding process. In this process, the upper end of the upright portion of the long side frames 2*a* and 2*b* and the shadow mask 1 are welded with each other. The welding is carried out by using, for example, a roller electrode 13 shown in FIG. 2(*b*). After the welding is completed, the compression force to the mask frame is released.

FIG. 2(*c*) shows the state in which the unnecessary part of the mask frame 2 of the shadow mask 1 is cut after the welding is completed. Through the above-mentioned processes, the shadow mask is stretched and fixed.

In the above-mentioned embodiment, the one-dimensional tension type shadow mask in which tension force is applied only to the vertical direction of the shadow mask is described. However, by the two-dimensional tension type shadow mask in which tension force is applied to both the vertical direction and horizontal direction, the same effect can be obtained.

Furthermore, for the shape of the mask frame, only the L-shaped cross section is explained. However, as shown by the double-dashed lines, the shape to which the oblique side 14 (shown in FIG. 3) is added for reinforcement may be employed.

Furthermore, the long side frame is formed by bending one plate material. Additional plate materials may be fixed to the upright portion of the L-shaped portion by welding, or the like. In this case, the shadow mask is welded to the additional plate material.

Furthermore, in the embodiment, the example of the slot type shadow mask is described, however, the shadow mask may be of the dotted type or the aperture grill type.

Furthermore, in the embodiment, the case where the shadow mask is fixed to the mask frame in a curved form is explained. However, it may be fixed in a plain form or other suitable forms.

The invention may be embodied in other specific forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A method for manufacturing a color cathode ray tube comprising:

applying a compression force to a mask frame that is formed in a frame shape in the direction in which a gap between at least a pair of facing sides is reduced; and fixing a shadow mask to an upper surface of said mask frame by welding while a tension force is applied in a direction opposite to said compression force, wherein a place to which said compression force is applied is an upper end of an external surface of said mask frame, and wherein said compression force is applied by bringing a flexible plate member into a direct contact with an entire length of one side of said mask frame.

2. A method for manufacturing a color cathode ray tube comprising:

applying a compression force to a mask frame that is formed in a frame shape in the direction in which a gap between at least a pair of facing sides is reduced; and fixing a shadow mask to an upper surface of said mask frame by welding while a tension force is applied in a direction opposite to said compression force, wherein a place to which said compression force is applied is an upper end of an external surface of said mask frame, and wherein said shadow mask is held at a predetermined position by a holding means before a tension force is applied to said shadow mask, thereby positioning said shadow mask.

3. The method for manufacturing a color cathode ray tube according to claim 2, wherein said holding means uses a magnet adhering to said shadow mask.

4. The method for manufacturing a color cathode ray tube according to claim 2, wherein said holding means adheres to said shadow mask by a suction force by vacuum pulling.

5. The method for manufacturing a color cathode ray tube according to claim 2, wherein said shadow mask is held in a curved shape by said holding means.

6. The method for manufacturing a color cathode ray tube according to claim 5, wherein said curved shape is held by adhering to said shadow mask to a curved portion formed on said holding means.

7. The method for manufacturing a color cathode ray tube according to claim 2, wherein said shadow mask is stretched outward with respect to its center by using said holding means in a state in which it is fixed to said holding means, thereby fixing said shadow mask to said holding means while being stretched.

8. A manufacturing apparatus, comprising:

means for applying a compression force to a mask frame that is formed in a frame shape in the direction in which a gap between at least a pair of facing sides is reduced, and means for fixing a shadow mask to an upper surface of said mask frame by welding with a tension force applied in a direction opposite to said compression force;

said apparatus comprising a pressure device for applying said compression force, wherein a place to which said compression force is applied is an upper end of an external surface of said mask frame, and wherein said pressure device has a flexible plate member having a length ranging a full length of one side of said mask frame, and application of said compression by said pressure device is carried out by bringing a flexible plate member into a direct contact with an entire length of one side of said mask frame.

9. A manufacturing apparatus, comprising:

means for applying a compression force to a mask frame that is formed in a frame shape in the direction in which a gap between at least a pair of facing sides is reduced, and means for fixing a shadow mask to an upper surface of said mask frame by welding with a tension force applied in a direction opposite to said compression force;

said apparatus comprising a pressure device for applying said compression force, wherein a place to which said compression force is applied is an upper end of an external surface of said mask frame, and wherein said apparatus has a holding means for holding said shadow mask at a predetermined position, and said shadow mask is held at a predetermined position by said holding means before a tension force is applied, thereby positioning said shadow mask.

10. The manufacturing apparatus according to claim 9, wherein said holding means uses a magnet adhering to said shadow mask.

11. The manufacturing apparatus according to claim 9, wherein said holding means adheres to said shadow mask by using a suction force by vacuum pulling.

12. The manufacturing apparatus according to claim 9, wherein said shadow mask is held in a curved shape by said holding means.

13. The manufacturing apparatus according to claim 12, wherein said curved shape is held by adhering said shadow mask to a curved portion formed on said holding means.

14. The manufacturing apparatus according to claim 9, wherein said shadow mask is stretched outward with respect to its center by said holding means in a state in which it is fixed to said holding means, thereby fixing said shadow mask to said holding means while being stretched.

* * * * *